United States Patent [19]

Arai

[11] Patent Number: 4,733,271

[45] Date of Patent: Mar. 22, 1988

[54] IMAGE REPRODUCTION APPARATUS WITH DETECTOR FOR DETECTING POSITION OF MOVEABLE COPIER UNIT

[75] Inventor: Koichi Arai, Higashiyamatoshi, Japan

[73] Assignees: Casio Computer Co., Ltd.; Casio Electronics Manufacturing Co., Ltd., both of Tokyo, Japan

[21] Appl. No.: 814,798

[22] Filed: Dec. 30, 1985

[30] Foreign Application Priority Data

Apr. 30, 1985 [JP] Japan ..... 60-93283
Apr. 30, 1985 [JP] Japan ..... 60-93284

[51] Int. Cl.[4] ..... G03G 15/00

[52] U.S. Cl. ..... 355/5; 355/3 R; 355/7; 355/14 R

[58] Field of Search ..... 355/5, 7, 3 R, 43, 53, 355/54, 64, 60

[56] References Cited

U.S. PATENT DOCUMENTS

| | | | |
|---|---|---|---|
| 3,473,451 | 10/1969 | Greenly et al. | 355/43 X |
| 3,480,360 | 10/1969 | Mallory et al. | 355/43 X |
| 4,194,833 | 3/1980 | Lester et al. | 354/5 X |
| 4,367,033 | 1/1983 | Watanabe | 355/5 |
| 4,371,898 | 2/1983 | Nakamura | 355/7 X |
| 4,541,706 | 9/1985 | Kishi | 355/5 X |
| 4,648,706 | 3/1987 | Shibasaki . | |
| 4,687,318 | 8/1987 | Shibasaki . | |

FOREIGN PATENT DOCUMENTS

| | | |
|---|---|---|
| 55-27889 | 7/1980 | Japan . |
| 56-40341 | 9/1981 | Japan . |
| 56-40342 | 9/1981 | Japan . |
| 57-158858 | 9/1982 | Japan . |
| 59-171695 | 9/1984 | Japan . |
| 59-212070 | 11/1984 | Japan . |
| 59-212866 | 12/1984 | Japan . |

*Primary Examiner*—A. C. Prescott
*Attorney, Agent, or Firm*—Sandler & Greenblum

[57] ABSTRACT

An image reproduction apparatus capable of reproducing the images which are recorded on the original and on the board sheet which is able to move is used. The image reproducing apparatus consists of the board section including the board formed as a sheet and the reproducing section capable of moving forward or backward to the board section. A detecting means for detecting the position in which the reproducing section is towards the board section is arranged on the board section and the reproducing section. The image reproduction apparatus confirms the position at which the reproducing section is outputted according to the detecting means, and thus the image reproduction apparatus reproduces the image on the board sheet and on the original.

13 Claims, 17 Drawing Figures

IMAGE REPRODUCTION APPARATUS WITH DETECTOR FOR DETECTING POSITION OF MOVEABLE COPIER UNIT

BACKGROUND OF THE INVENTION

1. Field of the Invention

The present invention relates to an image reproduction apparatus capable of reproducing images written both on a blackboard and on originals.

2. Discussion of Prior Art

Letters, figures, and the like, written on blackboards during meetings and lectures, have been conventionally transcribed onto notebooks.

In order to relieve participants from hand transcriptions and the attendant mistakes therein, an image reproduction apparatus has been proposed which is capable of directly reproducing letters and the like written on a blackboard.

Image reproduction apparatus of this type comprises a blackboard unit and a reproduction unit, in which the reproduction unit can reproduce images from originals and which is adapted to be pulled and held at a predetermined position forwardly of the blackboard unit when images on originals are to be reproduced, and which is pushed rearwardly to combine with the blackboard unit when an image on the blackboard is to be reproduced.

When reproduction is effected, with the reproduction unit not correctly pulled to a predetermined position forwardly of the blackboard unit or pushed rearwardly so as to properly combine with the blackboard unit, the original table on the reproduction unit, which slides rightwardly and leftwardly during reproduction of images from originals, will strike elements around it, and may thus be broken because the reproduction unit is not properly held at a predetermined push-back position. The reproduction unit must stop its reproduction to prevent such damage, but when it is stopped during reproduction, papers on which original images are to be reproduced which are left in the apparatus thereby jam it.

In addition, images on the blackboard cannot be accurately reproduced because light, including image information, will not completely enter an exposure opening within the reproduction unit. The image will be reproduced as a solid black, thereby wasting toner and imposing an excessive load on the cleaner. When reproduction is stopped to prevent such a problem, however, papers are left jammed in the apparatus, thereby increasing the possibility of accidents. When it is stopped during reproduction, papers on which the original images are to be reproduced are left in the apparatus, thereby jamming it.

Additionally, images on the blackboard cannot be accurately reproduced because the light, including image information, will not fully enter an exposure opening in the reproduction unit. The image is reproduced as a solid black, thereby wasting toner and imposing an excessive load on the cleaner. When reproduction is stopped in order to prevent such a problem, however, papers are left jammed in the copying apparatus, which can cause accidents.

SUMMARY OF THE INVENTION

The present invention is directed to overcoming such drawbacks, and one object of the present invention is to provide an image reproduction apparatus capable of reproducing images written on a blackboard and on originals without breaking the original table during reproduction of images from originals; and the apparatus is capable of reproducing images not as solid black images, but as normal images, thereby reducing the amount of toner used to as small a degree as possible.

In order to achieve such an object, the present invention provides an image reproduction apparatus which includes a display unit having a display face on (and from) which images can be written and erased; and a reproduction unit which is releasable from the display unit, which can selectively reproduce images written on the display face and on the originals. The reproduction unit includes a photosensitive body on which electrostatic latent images corresponding to those on the display face or on the originals are formed, means for removing unnecessary charges from the surface of the photosensitive body, and a detector assembly for detecting movement of the reproduction unit. The charge removing means is operative to be effected during a reproduction operation when the detector assembly detects that the reproduction unit is not combined with the display unit to reproduce an image on the display face, nor when the detector assembly detects movement of the reproduction unit during reproduction of images on originals.

DETAILED DESCRIPTION OF THE INVENTION

Figure 2:
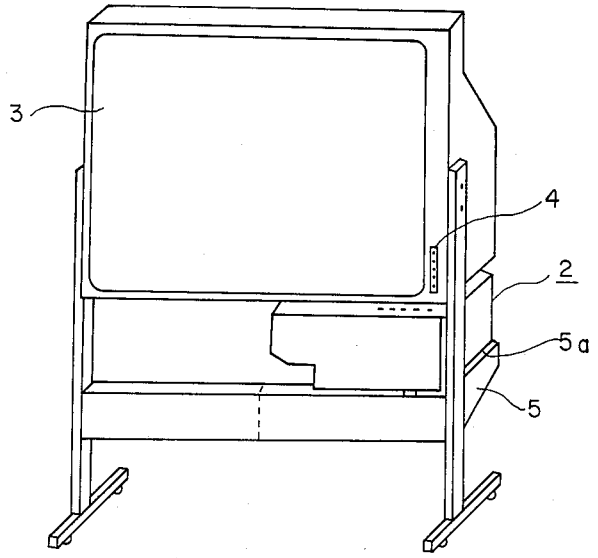
FIGS. 2 and 3 are perspective views illustrating an image reproduction apparatus formed in accordance with the present invention.
Figure 3:
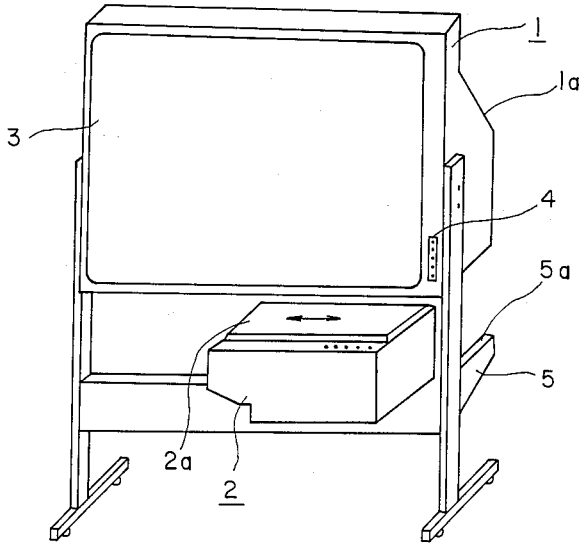

FIGS. 2 and 3 are perspective views illustrating the overall image reproduction apparatus formed in accordance with the present invention. FIG. 2 represents, the image being reproduced from a board, and FIG. 3 illustrates an image reproduced from an original.

The reproduction apparatus includes a board unit on a reproduction unit 2. Board unit 1 comprises a frame 1*a*, a board sheet 3, and an operation panel 4, and houses a board optical system and a winding apparatus. Original table 2*a* is provided with a cover and is mounted onto reproduction unit 2, which unit is mounted on a rail which is described hereinafter and which moves forwardly and backwardly on the rail.

When the image on original table 2*a* is to be reproduced, reproduction unit 2 is moved forwardly from board unit 1, as illustrated in FIG. 3; when the image on board sheet 3 is to be reproduced, original table 2*a* is moved rearwardly, as shown in FIG. 2.

When the image on board sheet 3 is to be reproduced, board sheet 3 is wound by a winding roller within frame 1*a*, with the image on the thus moving board sheet 3 being irradiated by light, and light which is reflected from the sheet enters an exposure opening formed at a predetermined position along reproduction unit 2.

Original table 2*a* on reproduction unit 2 includes a glass plate, a cover and similar structure, and is reciprocated in a direction as illustrated by arrows in FIG. 3 when the image on an original is reproduced.

Figure 1A:
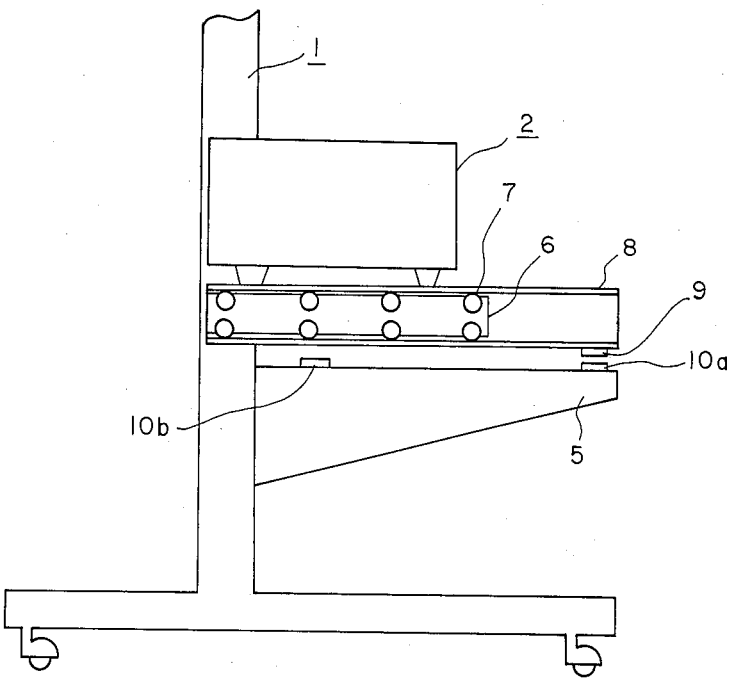
FIGS. 1*a*, 1*b* and 1*c* illustrate a movable reproduction unit illustrating a main portion of the present invention.
Figure 1B:
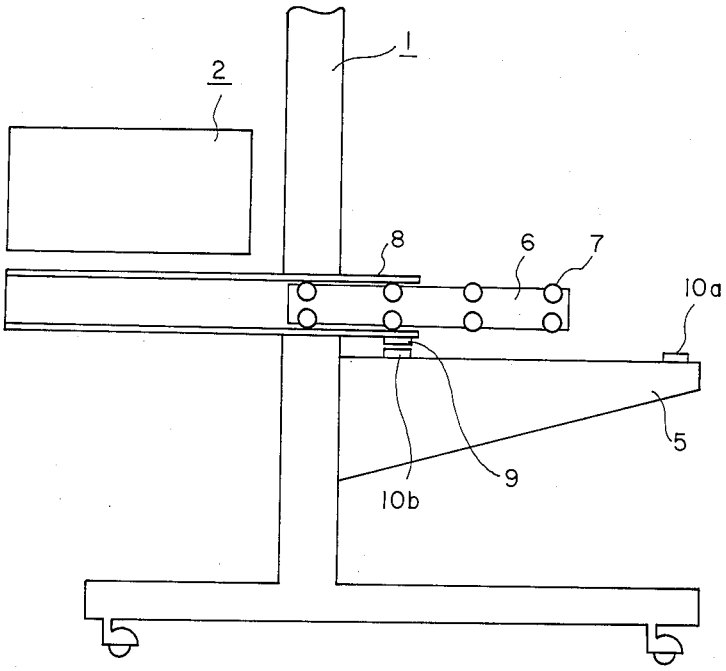
Figure 1C:
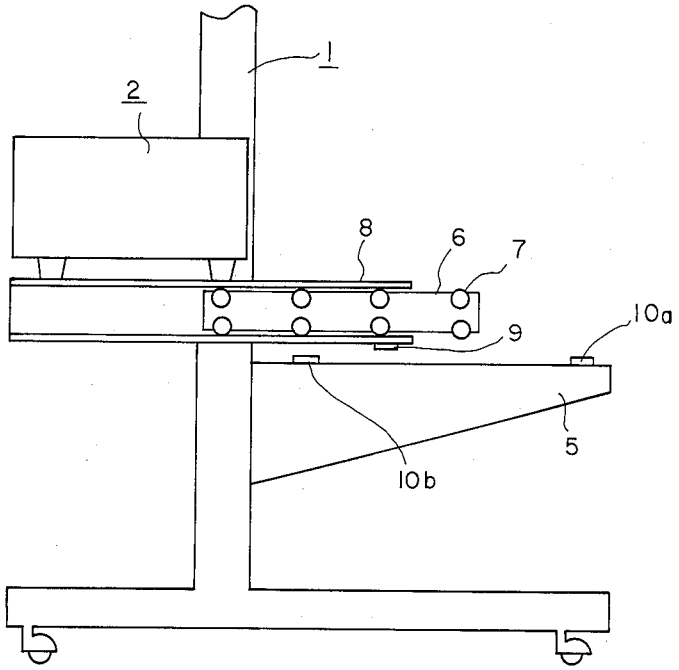

FIGS. 1*a*, 1*b* and 1*c* represent the right side of an image reproduction apparatus, wherein FIG. 1*a* illustrates reproduction unit 2 pushed back completely, as illustrated in FIG. 2; FIG. 1*b* illustrates reproduction unit 2 pulled completely forwardly, as shown in FIG. 3; and FIG. 1*c* illustrates reproduction unit 2 stopped at a point at which it is moving forwardly or rearwardly.

Frame 1*a* is omitted in FIGS. 1*a*, 1*b* and 1*c* in order to clarify the movement of reproduction unit 2. Rail 6 is attached to board unit 1 by a mechanism (not shown in the drawings), and four freely rotatable rollers 7 are attached to each of the upper and lower sides of a fixed or stationary rail 6. A moving rail 8 is freely and slidably attached to fixed rail 6 with runners 7 interposed between them, and a magnet 9 is attached to the underside of moving rail 8 and the back end portion of the rail. Two reed switches 10*a* and 10*b* are arranged along the upper surface of support 5. Reed switch 10*a* is positioned so that it corresponds to magnet 9 on the underside of moving rail 8 when unit 2 reaches the position illustrated in FIG. 1*a*, while reed switch 10*b* is positioned so that it will correspond to magnet 9 on the underside of the moving rail when reproduction unit 2 reaches a second position as illustrated in FIG. 1*b*.

In other words, reed switch 10*a* is positioned under magnet 9 when reproduction unit 2 is reproducing an image on the board sheet; whereas reed switch 10*b* is positioned under magnet 9 when reproduction unit 2 is reproducing an image from an original. Each of the reed switches 10*a* and 10*b* is turned on when magnet 10 is positioned directly over the switches, thereby outputting signals, described hereinafter, to control reproduction.

Figure 4:
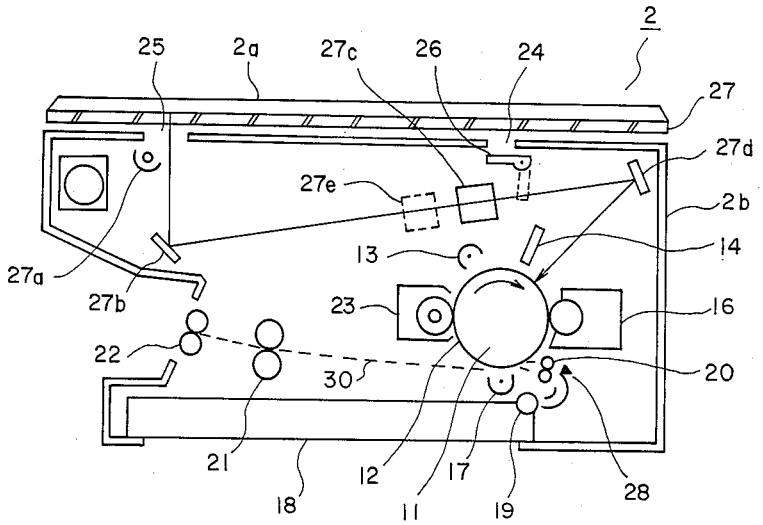
FIG. 4 represents a reproduction unit forming a portion of the apparatus of FIGS. 2 and 3.

FIG. 4 illustrates an arrangement of the reproduction unit 2. When an image on the original (not shown), which is placed on a glass plate 27, is to be reproduced, the original is irradiated by light rom light source 27*a*, and the light thus reflected from the original is introduced onto photosensitive surface 12 of a photosensitive drum 11 via a first mirror 27*b*, lens 27*c*, and second mirror 27*d*. Photosensitive surface 12 has been uniformly charged by this time by a charger 13, and charge has been removed from its non-image portion by a charge moving lamp 14. An electrostatic latent image is thereby formed on photosensitive surface 12 by irradiation (or by exposure) of the reflected light. The electrostatic latent image on photosensitive surface 12 becomes visible as a toner image via developing means 16, and the toner image is then transferred via transfer means 17 onto a sheet of paper which is fed from paper supply cassette 18 via paper supply roll 19, and thereafter through rollers 20 in a timing sequence such that the paper will correspond to the forwardmost end of the toner image. The toner image transferred onto the paper is heat attached thereto by a fixing means 21, and is then discharged outwardly from the apparatus by paper discharging rollers 22. Toner which remains on the photosensitive surface 12 because it is not transferred by transfer means 17 is removed by a cleaner 23; and photosensitive surface 12 is again uniformly charged by charger 13 to ready itself for the next exposure.

Box 2*b* of reproduction unit 2 is provided with an exposure opening 24 during board sheet reproduction, and a second exposure opening 25 is provided for use during reproduction of originals under glass plate 6. A shutter 26 is provided under exposure opening 24 in order to prevent exterior light from entering reproduction unit 2, and switch 28 is provided along passage 30, through which paper is fed, in order to check paper passed therethrough.

Figure 5:
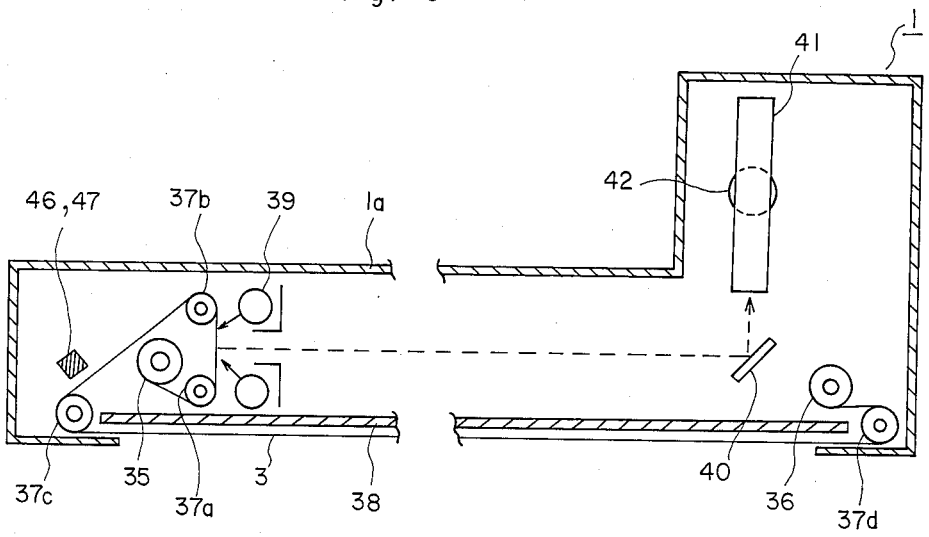
FIG. 5 illustrates one arrangement of a board section of the apparatus of FIGS. 2 and 3.

In FIG. 5, the winding apparatus comprises winding rollers 35, 36, feed rollers 37*a*–37*d* and similar structure. Board sheet 3 which has been wound about winding roller 36 is rewound by winding roller 35 via rollers 37*a*–37*d* at a uniform speed which is controlled by a drive assembly (not illustrated). Board sheet 3, which has thus been wound about winding roller 35, is again rewound by winding roller 36. Board sheet 3 which is wound and rewound in this fashion is held by feed rollers 37*a*–37*d* in order to form a surface which is horizontal to frame 1*a*. Board sheet 3 is also held horizontally with respect to frame 1*a* by a back-up board 38.

The blackboard optical system comprises a fluorescent lamp 39, a first mirror 40, second mirror 41, and lens 42, wherein board sheet 3 is held flat between feed rollers 37*a* and 37*b* and is adapted to be irradiated by fluorescent lamp 39.

Figure 6:
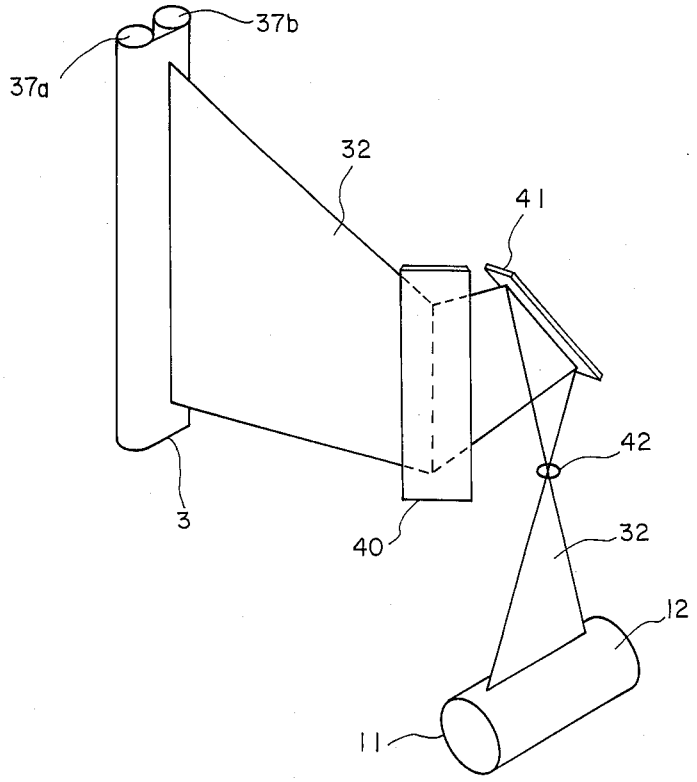
FIG. 6 represents one example of a light path in the board section.

FIG. 6 illustrates the passage of light 32 which is reflected from board sheet 3 when the board sheet, on which letters, figures and the like were written, is irradiated by fluorescent lamp 39.

As illustrated in FIG. 6, reflected light 32 is bent by 90° by first mirror 40, which mirror is inclined by 45° with respect to reflected light 32. The reflected light is further bent downwardly by 90° by second mirror 41, and is introduced onto photosensitive drum 11, within reproduction unit 2, via lens 42. When reproduction unit 2 is combined with board unit 1, shutter 26, glass plate 27, and reproduction lens 27*c*, all of which are within the path of reflected light 32, are moved into their predetermined positions when power source switch 48 is turned on. Specifically, shutter 26 is moved into a position illustrated by the broken lines in FIG. 4, and glass plate 27 is moved into a position in which it does not close exposure opening 24, so that reflected light 32 which has traversed lens 42 can irradiate a photosensitive surface 12, thereby passing through exposure opening 24 in box 2*b*. Furthermore, reproduction lens 27*c* has also been moved into a position 27*e*, illustrated by the broken line in FIG. 4, so as not to shield the path of reflected light 32. Other elements, e.g., the mirror in the optical system, will also be moved into respective positions in which they do not shield the path of reflected light 32, when they are in the path of the reflected light. After photosensitive surface 12 is irradiated by reflected light 32, the image on board sheet 3 is reproduced on the sheet of paper during the course of developing, transferring and cleaning processes which are the same as those in the original reproduction operation.

Figure 7:
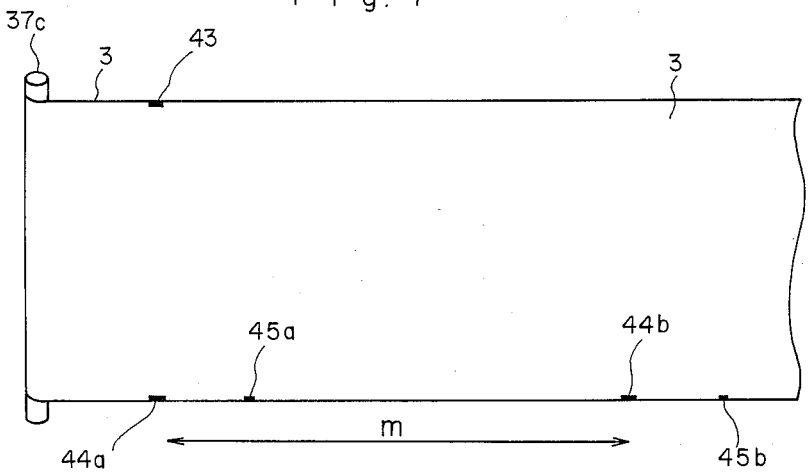
FIG. 7 is an example of a display board sheet.
Figure 8:
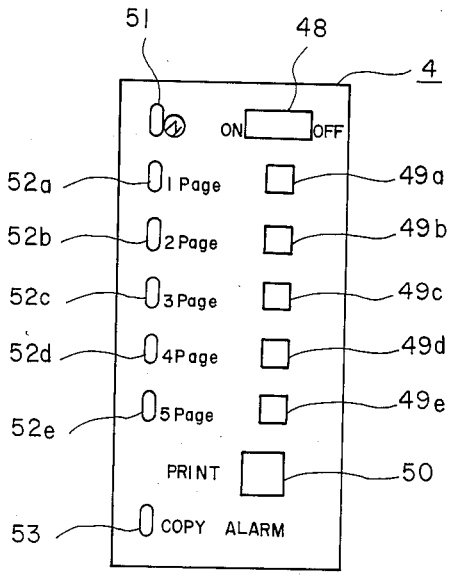
FIG. 8 is an example of an operation panel.

As illustrated in FIG. 7, board sheet 3 is provided with a first page detection mark at a position along an upper side edge of the sheet. The sheet is also provided with page detection marks 44*a*, 44*b* . . . , and timing marks 45*a*, 45*b* . . . , respectively, on the lower side edge of the sheet. The page detection marks are separated by a predetermined interval (m) from each other, as are the timing marks. The page detection marks continue until reaching the last page detection mark 44e (not shown in the drawings), and board sheet 3 is thereby divided into five pages. Mark sensors 46 and 47 are provided in board unit 1, which corresponds to the first page detection mark 43, page detection marks 44a–44e, and timing marks 45a–45e, respectively.

Board operation panel 4 includes a power source switch 48, a plurality of page designation switches 49a–49e, a printing switch 50, a power source lamp 51 which is adapted to be turned on when the power source switch 48 is turned on, page display lamps 52a–52e, which are turned on when page designation switches 49a–49e are switched on, and an alarm lamp 53.

Alarm lamp 53 is turned on when a detector (not illustrated) detects the fact that reproduction unit 2 is not in a position in which the image on board sheet 3 is being reproduced; and the lamp flickers when reproducing conditions are not appropriate, i.e., either when no paper is present or when the fixing means 21 is not raised to a predetermined temperature.

In the situation in which mark sensor 46 does not detect the first page detection mark 43 when power source switch 48 is switched into an on position, winding roller 36 is driven by a control mechanism in order to move board sheet 3 into a position in which mark sensor 46 will detect the first page detection mark 43.

Figure 9:
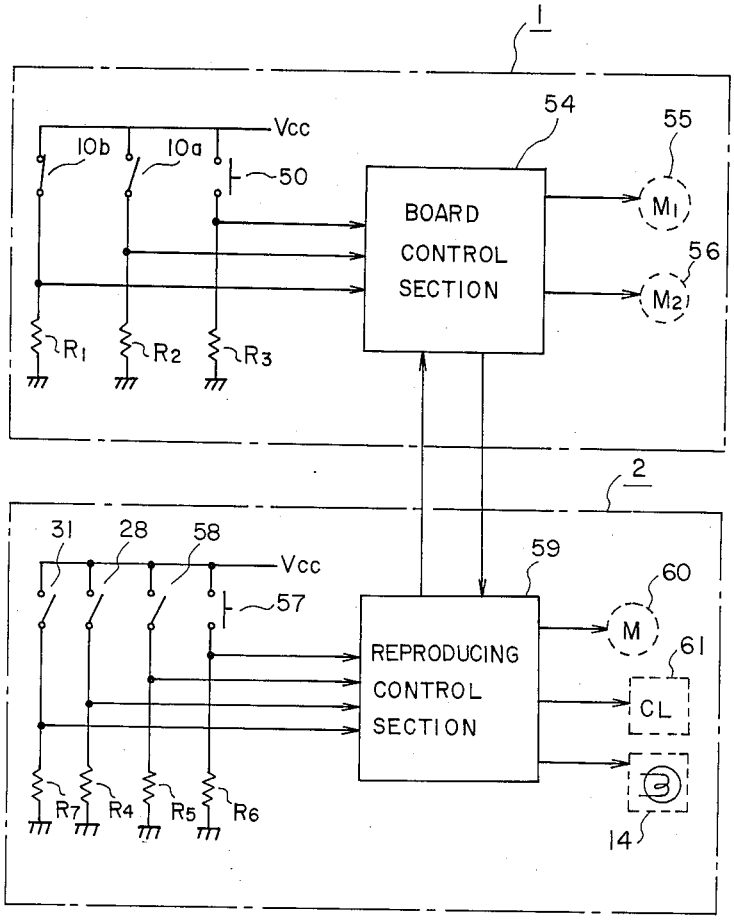
FIG. 9 is circuit diagram illustrating a circuit which is used with the image reproduction apparatus of the present invention.

One control circuit used by the above-described imager production apparatus is illustrated in FIG. 9. This control circuit, located on one side of board unit 1, includes a print switch 50, reed switches 10a and 10b, resistors $R_1$, $R_2$, and $R_3$, and a board control section 54. One end of each of print switch 50 and reed switches 10a and 10b is connected to a power source (Vcc), and the other end of each of the switches is grounded through resistors $R_1$, $R_2$, and $R_3$, respectively. Points between print switch 50 and resistor $R_3$, reed switch 10a and resistor $R_2$, and reed switch 10b and resistor $R_1$, respectively, are connected to board control section 54 and serve to apply on and off signals for the switches and sensors to board control section 54. When print switch 50 is pushed downwardly, the signal added to board control section 54 has the same voltage as power source Vcc, and board control section 54 detects, in response to such a voltage level, that the printing switch has been pushed downwardly. When this switch is not pushed downwardly, however, a voltage level grounded through resistor $R_3$, i.e., through the zero level, is added to board control section 54. Each of resistors $R_3$, $R_1$ and $R_2$ are of a pull-down type to ensure that signals added to board control section 54 will be at the zero level. When reproduction unit 2 is in its normal position, in which an image on the board sheet or on the original is reproduced, reed switched 10a and 10b are switched on, and a voltage which is the same as that of power source Vcc is added to board control section 54. In response to this voltage level, board control section 54 detects the fact that reproduction unit 2 is at its normal position. Further, board control section 54 will apply control signals to motors 55 and 56 in order to drive the board sheet winding rollers 35 and 36, respectively.

To the contrary, the circuit on the side of reproduction unit 2 includes a printing switch 57, an original table limiting switch 58, a waiting switch 28, a paper discharge switch 31, resistors $R_4$, $R_5$, $R_6$ and $R_7$, and a reproduction control section 59. One end of each of the print switch 57, original table limiting switch 58, waiting switch 28, and paper discharge switch 31 is connected to power source Vcc, with the other end of each of the switches being grounded through resistors $R_4$, $R_5$, $R_6$ and $R_7$, respectively. Points between print switch 57 and resistor $R_6$, between original table limiting switch 58 and resistor $R_5$, between waiting switch 28 and resistor $R_4$, and between the paper discharge switch 31 and resistor $R_7$, respectively, are connected to reproduction control section 59 in order to apply on-and-off signals from the switches and sensors to reproduction control section 59. When print switch 57, original table limiting switch 58, paper discharge switch 31, and waiting switch 28 are either turned on or off, signals which are the same in voltage level as those of power source Vcc, or zero, are added to reproduction control section 59. This section detects the change in the level of the signals. For example, when waiting switch is switched on, it detects that paper is passing over feed path 30 of FIG. 4. Additionally, this waiting switch detects that the print switch has been pushed downwardly, that the original table has been moved to its final end position, and that the paper has been discharged.

Further, it applies control signals to a motor 60 for driving photosensitive drum 11, clutch 61, and electrical-removing lamp 14.

The board and reproduction control sections 54 and 59 are connected to each other via an interface, and serve to exchange control signals and data between them.

Figure 10A:
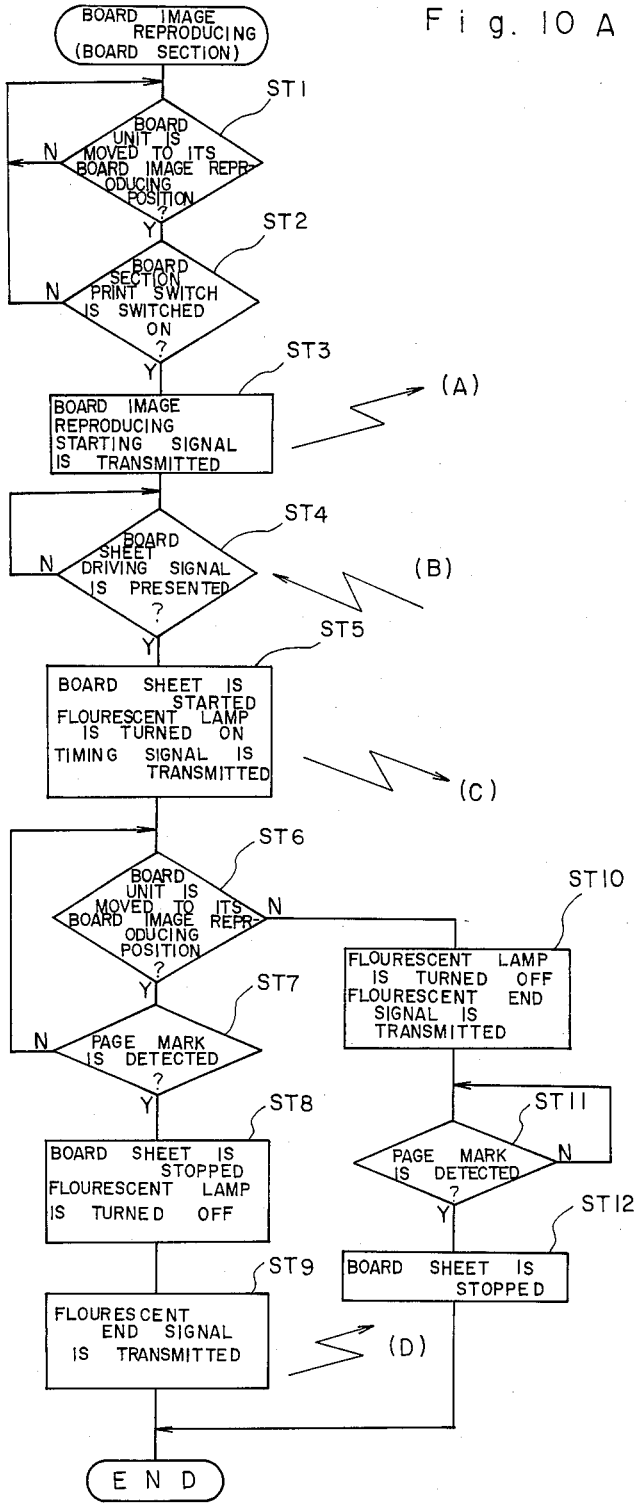
FIGS. 10*a*, 10*b*, 10*c*, 11*a*, 11*b* and 11*c* are flow charts.
Figure 10B:
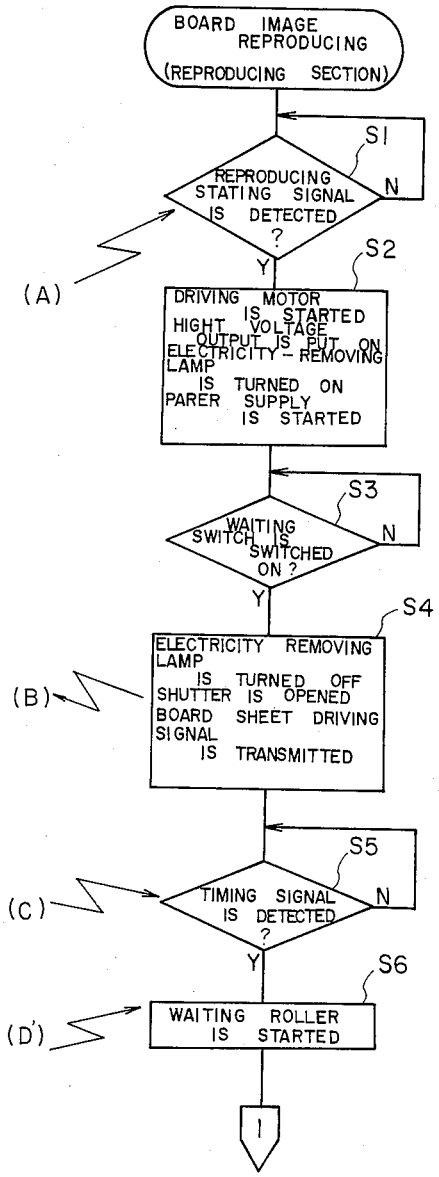
Figure 10C:
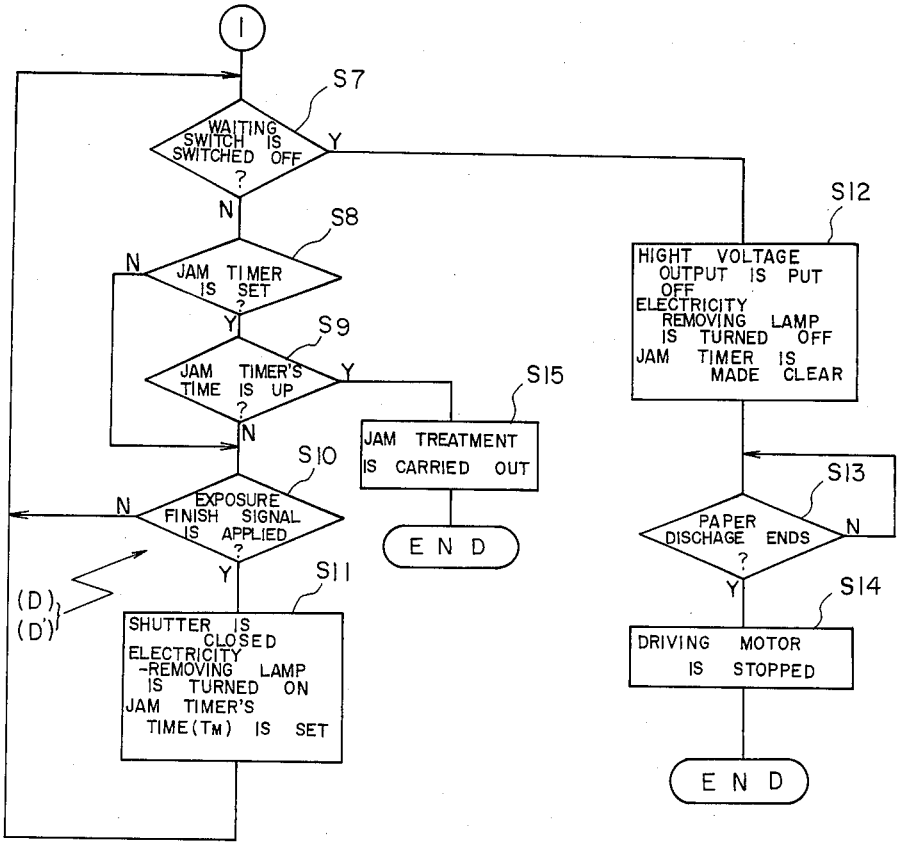

In a case in which the image on board sheet 3 is to be reproduced with the image reproduction apparatus of the present invention, reproduction unit 2 is moved and combined with board unit 1, as described above, and the image reproduction operation is advanced following the flow charts of FIGS. 10A and 10B. FIG. 10A illustrates the process flow on one side of board unit 1, while FIGS. 10b and 10c illustrate another process flow along one side of reproduction unit 2. However, both of these process flows are effected in association with each other when the image on board sheet 3 is to be reproduced. Accordingly, the description which follows illustrates the use of steps ST in the flow chart of FIG. 10a, and steps S in the flow charts of FIGS. 10B and 10C.

On one side of board unit 1, dependent upon whether a signal has been applied from reed switch 10a, a determination is made as to whether or not reproduction unit 2 has been moved to its board image reproducting position (i.e., step $ST_1$). This judgement (or step ST) depends upon the signal being applied from reed switch 10a, as described above. When the reed switch is switched off, reproduction unit 2 is not moved to its board image reproducting position (i.e., NO). Therefore, the determination, or step $ST_1$, is repeated until reproduction unit 2 is detected as being located at its normal position. When reed switch 10a is switched on, step $ST_1$ detects that the reproduction unit is at its normal or board image reproducing position, i.e., YES. Accordingly, board image reproduction which is described hereinafter is effected only one time. When reproduction unit 2 is at its board image reproducing position (YES), the system determines whether or not to turn the print switch 50 on, i.e., step $ST_2$. When print switch 50 is not switched on, i.e., NO, the determination or step $ST_1$ is again repeated, irrespective of whether the reproduction unit 2 is at its board image reproducing position. When print switch 50 is switched into the on position, a signal (A) used to initiate the board image reproduction is applied from board control section 54 to reproduction control section 59 (i.e., step $ST_3$), and awaits a board sheet driving signal which will be described hereinafter.

Reproduction unit 2 then ascertains whether or not the board image reproduction starting signal (A) is present, as in step $S_1$, and this judgement, or step $S_1$, is repeated until it can be determined that the reproduction starting signal is present, i.e., that it is YES. When no reproduction starting signal is present, the process is prevented from advancing, i.e., NO, and the judgement or step $S_1$ is again made. The board image reproduction starting signal (A) indicates that the board control unit 54 has detected that reproduction unit 2 is at its normal reproduction position, and that print switch 50 has been pushed downwardly. In response to this signal, the reproduction unit 2 effects the process of initiating board image reproduction. When a board image reproduction starting signal is inputted, the judgement or step $S_1$ determines that the signal is present, i.e., that it is YES, and the drive motor 60 is driven. The output voltage is increased, the electricity removing lamp is turned on, and the paper supply roller is rotated to feed paper onto the feed passageway, i.e., in step $S_2$. It is then determined whether or not the paper which is on the feed path has turned waiting switch 28 on, i.e., step $S_3$ is performed. When waiting switch 28 is not switched on, i.e., at NO, the determination is again repeated. When the waiting switch 28 is switched into its on position, i.e., when step $S_3$ is YES, the electricity removing lamp is turned off and shutter 26 is opened to output a board sheet driving signal (B) the electricity removing lamp is turned off and shutter 26 will be opened in order to output a board sheet driving signal (B) from reproduction control section 59 to board control section 54 (i.e., step $S_4$ is performed). In response to this applied board sheet driving signal, board control section 54 ascertains that the board sheet driving signal is present, i.e., that step $ST_4$ is YES, which then causes motor 55 to be driven, board sheet 3 to begin its movement, and exposure lamp 39 to be put into an ON position. When mark sensor 47 detects any of the timing marks **45*a*–45*e* on board sheet 3, a timing signal (C) will be applied to the reproduction control section 59 (i.e., step $ST_5$). When timing signal C is received, reproduction unit 2 ascertains that the timing signal is present, i.e., that step $S_5$ is YES, which causes waiting roller 20 to be driven (see step $S_6$) in order to feed paper towards transfer mechanism 17**. This paper feeding initiates the transfer operation.

One side of board unit 1, the signal applied by reed switch **10*a* during reproduction is watched, and a determination is made as to whether or not reproduction unit 2 is at its board image reproduction position, i.e., see step $ST_6$. When reproduction unit 2 is at its normal or board image reproduction operation, i.e., when step $ST_6$ is YES, a determination is then made as to whether or not any of the page detection marks 44*a*–44*e* has been detected, i.e., see step $ST_7$. When one of the page detection marks is so detected, board sheet 3 will be stopped, and exposure lamp 39 will be turned off, i.e., see step $ST_8$. An exposure finish signal D is then applied to the reproduction unit side, i.e., see step $ST_9$. Because the determination, at step $ST_9$, as to whether or not reproduction unit 2 is at its board image reproducing position is repeated until one of the page detection marks has been detected, correct reproduction will be completed without any abnormal movement of reproduction unit 2 when it has been determined, i.e., at step $ST_7$, that a page detection mark is present, i.e., YES. When reproduction unit 2 is moved forwardly and shifted from its board image reproduction position in an accidental fashion, it can be detected from the output of reed switch 10*a* that the reproduction unit 2 is not at its board image reproducing position, i.e., step $ST_6$ will be NO; the exposure lamp 39 will be immediately turned off, and an exposure finish signal D' will be sent to reproduction control section 59, i.e., see step $ST_{10}$. Thereafter, the same process as that described above advances on the side of board unit 1, and when mark sensor 47 detects one of the page detection marks 44*a*–44*e*, i.e., when step $ST_{11}$ is YES, board sheet 3** is terminated, i.e., see step $ST_{12}$.

Exposure lamp 39 is turned off as soon as it is confirmed by reed switch **10*a* that reproduction unit 2 has shifted. Accordingly, board sheet 3 will be moved without light being irradiated, so that photosensitive drum 11 will not be light irradiated through exposure opening 24 of reproduction unit 2**.

To the contrary, a determination is made on the side of reproduction unit 2 as to whether or not a jam is set, i.e., see step $S_8$, when the paper which has been fed towards transfer mechanism 17 does not pass over waiting switch 28, i.e., when step $S_7$ is NO. When the jam is not so set, the process is shifted to a step $S_{10}$, but when the jam is so set, a determination is made as to whether or not the jam timer's time for paper has been completed, i.e., see Step $S_9$. When the time is not over, i.e., when step $S_9$ is NO, a determination is made as to whether or not the exposure finish signal D or D' has been applied from the noted board control section 54 to reproduction control section 59, i.e., see step $S_{10}$. When an exposure finish signal D or D' is not applied, i.e., when step $S_{10}$ is NO, the process is repeatedly returned to step $S_7$ in order to determine whether or not the waiting switch 28 is switched off. When exposure finish signal D or D' is applied, i.e., when step $S_{10}$ is YES, shutter 26 is closed, electricity removing lamp 14 is turned on, and the jam timer is set, i.e., see step $S_{11}$, so that it can again be determined whether or not waiting switch 28 is switched into an OFF position, i.e., see step $S_7$. In a case in which paper does not turn off the waiting switch 28 over a predermined time period, i.e., over a time period in which the timer is set, and in which step $S_9$ is YES, it will be determined that paper has jammed the machine, and jam treatment will then be carried out, i.e., see step $S_{15}$. The above-noted timer's time period is set to be a sufficiently long period, considering that the exposure finish signal D' occurs faster than in normal reproducing operations, because reproduction unit 2 is shifted during board image reproduction. In a case in which the exposure finish signal D' has occurred, the jam timer's time set may be made longer than during a normal reproduction period. When it has been determined that waiting switch 28 is turned off, i.e., when step $S_7$ is YES, the transfer operation will be completed. Accordingly, the high voltage output will be put off, the electricity-removing lamp 14 will be turned off, and the jam timer will be cleared, i.e., see step $S_{12}$, so that it can be determined whether or not paper has been discharged outwardly, see step $S_{13}$. When it has been determined that paper has been so discharged, i.e., when step $S_{13}$ is yes, motor 60 will be stopped, i.e., see step $S_{14}$, and the reproduction operation will be completed.

The image on board sheet 3 is reproduced in accordance with the above-described flow. When reed switch 10*a* is not switched on simultaneously, as described above, during reproduction, however, the signal for driving exposure lamp 39 will not be outputted through board control section 54, and reproduction unit 2 will carry out its reproduction operation, thereby maintaining electricity-removing lamp 14 in a lit fashion, so that an image cannot be reproduced onto paper which is to be discharged.

According to the embodiment of the present invention which is described above, reproduction of image on board sheet 3 can be effected while detecting it with magnet 9 and reed switch 10*a*, irrespective of whether reproduction unit 2 is fully pushed rearwardly and combined with board unit 1. The present invention is therefore capable of solving the problem in which the image on board sheet 3 cannot be accurately reproduced because reproduction unit 2 reproduces the image on board sheet 3 in an abnormal position, and because the light containing image information on the board sheet will not be permitted to enter reproduction unit 2 through a predetermined position.

Figure 11A:
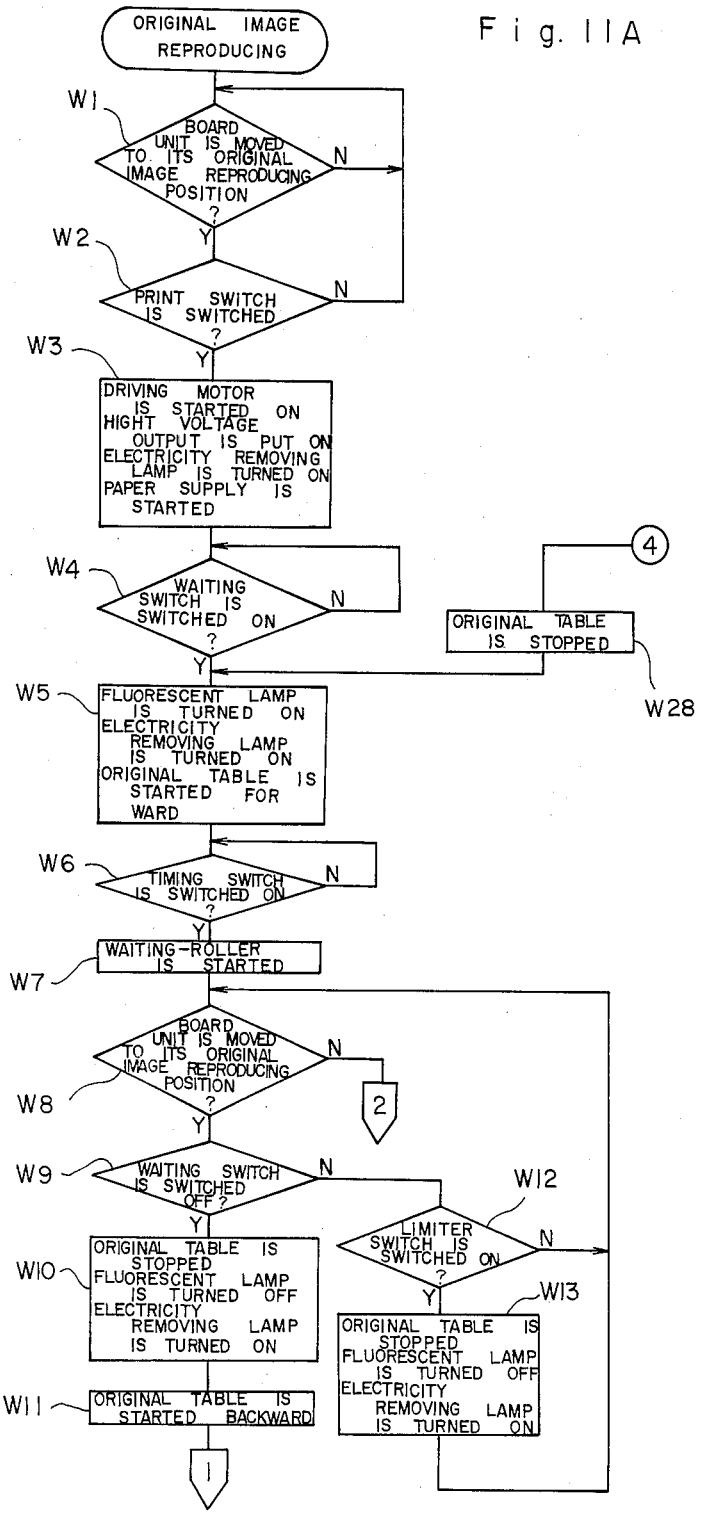
Figure 11B:
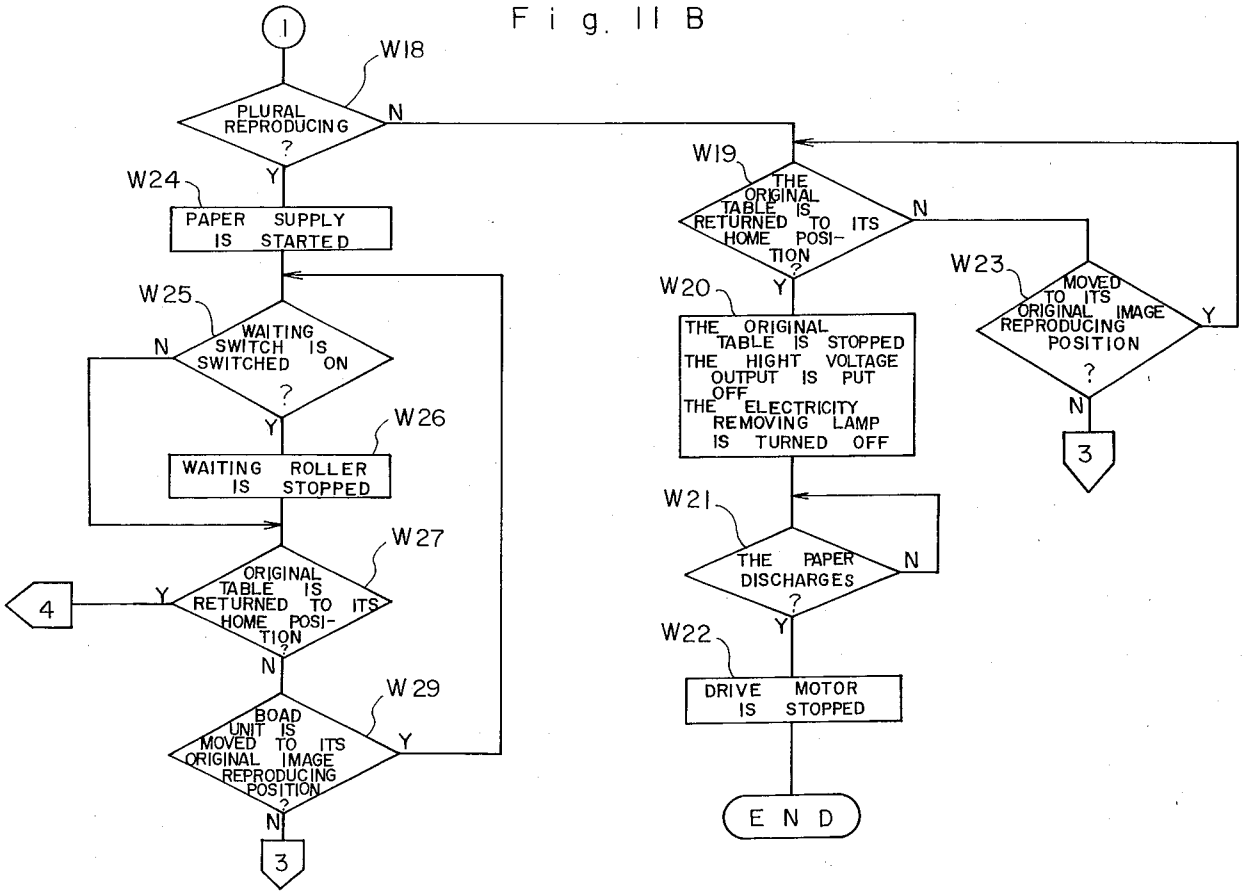
Figure 11C:
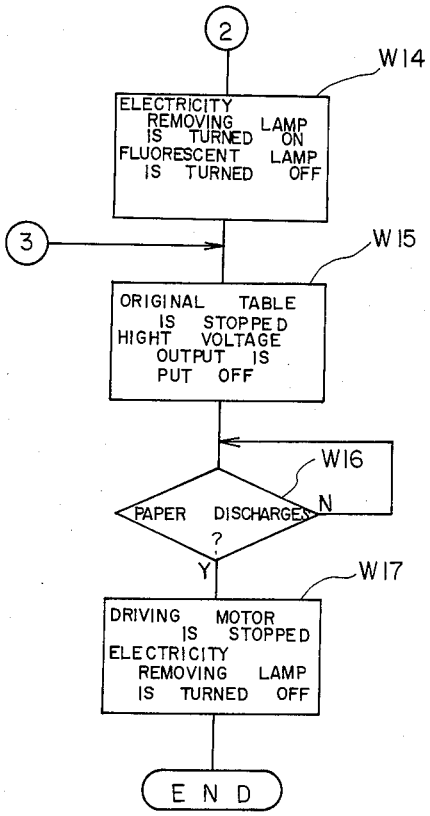

Another process for preventing original table 2*a* and similar structure at roduction unit 2 from being broken will now be described. This process works even when the reproduction unit carries out reproduction and after it has been confirmed that the unit 2 s been pulled forwardly with respect to board unit 1 in order to occupy its normal original image reproducing position. This process will be discussed with reference to the flow chart of FIGS. 11*a* through 11*c*.

Initially, the signal applied from reed switch 10*b* serves to determine whether or not reproduction unit 2 has been completely moved forwardly and located at its normal position, in ch it reproduces an image on the original, i.e., see step $W_1$. The determination, i.e. step $W_1$ depends upon the signal level applied from reed switch 10*b*, as noted above. When this switch is switched off, the reproduction unit 2 is not located at its original image reproduction position, i.e., NO. Therefore, the determination (or step $W_1$) is repeated until it detects that reproduction unit 2 is located at its normal position. When reed switch 10*b* is switched on, it serves to detect that the determination (or step $W_1$) that the reproduction unit 2 is located at its normal position, i.e., at YES. Therefore, the original image reproduction described hereinafter is effected at such time. When reproduction unit 2 is at a position in which it can reproduce an image on an original, it is then determined whether or not print switch 57 is switched on, i.e., see step $W_2$. When print switch 57 is not switched on, i.e., when it is NO, the determination step $W_1$, which determines whether or not reproduction unit 2 is located at its original image reproducing position, is again repeated. When print switch 57 is turned on, drive motor 60 is driven, the high voltage output is applied, electricity moving lamp 14 is turned on, and paper supply roller 19 is rotated to feed paper onto the feed path, i.e., see step $W_3$. It is then determined whether or not the paper which has been fed onto the feed passage will turn on waiting switch 28, i.e., see step $W_4$. When waiting switch 28 is switched off, i.e., NO, the determination (of step $W_4$) is repeated. When waiting switch 28 is turned on, the determination (of step $W_4$) becomes YES, and the electricity removing lamp 14 is turned off, with the exposure lamp being turned on in order to start forward scanning motion with respect to the original table (i.e. step $W_5$).

When the original table moves and the forwardmost end of the original reaches exposure opening 25, the timing switch (not shown) along the operation path of the original table is made operative. When a timing signal is received, it is then determined a to whether the timing signal is present, i.e., step $W_6$ is YES. Further, waiting rollers 20 are driven, i.e., see step $W_7$, and paper is fed towards transfer device 17. Reproduction is thus initiated and the image on the original is transferred onto the paper.

The signal applied from reed sensor 10*b* during reproduction is observed at board control section 54, and it is then determined whether or not reproduction unit 2 is at its original image reproducing position, i.e., see step $W_8$. When reproduction unit 2 is at its original image reproducing position, i.e., when step $W_8$ is YES, paper passes over waiting switch 28 and a determination is made as to whether or not the paper switches waiting switch 28 OFF, i.e., see step $W_9$. When this switch 28 is switched off, i.e., when step $W_9$ is YES, the original table is stopped, exposure lamp 27*a* is turned off, and the electricity removing lamp 14 is turned on, i.e., see step $W_{10}$. The original table is then withdrawn or retreated, i.e. see step $W_{11}$. When step $W_9$ is NO, at this time, it is then determined whether or not the limit switch 58 is switched on, i.e., see step $W_{12}$. When limit switch 58 is turned on, i.e., when step $W_{12}$ is YES, the original table will be stopped and the exposure lamp 27*a* will be turned off. The process will again be started from the determination stage, i.e., from step $W_8$.

If reproduction unit 2 is accidentally moved rearwardly from its reproduction position, it is then detected from the output of the reed switch 10*b* that the reproduction unit 2 is not at its original image reproduction position, i.e., step $W_8$ is NO. Immediately, exposure lamp 27*a* will be turned off and electricity removing lamp 14 will be turned on via branch 2 of the flow chart, i.e., see step $W_{14}$. The original table is then stopped and the high voltage output is put off, i.e., see step $W_{15}$. It is then determined whether or not paper has been discharged outwardly, see step $W_{16}$; drive motor 60 is stopped and an electricity removing lamp 14 is turned off, i.e., see step $W_{17}$.

When it is accordingly confirmed by reed switch 10*b* that reproduction unit 2 has been moved during a reproduction operation, the exposure lamp is immediately turned off and the original table is then stopped, thereby preventing photosensitive drum 11 from being light irradiated.

When the original table begins to retreat, as in step $W_{11}$, it is then determined whether the image on the original is to be reproduced in a single or plural fashion, see step $W_{18}$. When single reproduction is intended, i.e., when step $W_{18}$ is NO, completion of reproduction will be effected. It is first determined whether (or not) the original table has been returned to its original position, i.e., see step $W_{19}$. When returned, the original table will be stopped, the high voltage output will be put off, and the electricity removing lamp 14 will be turned off, i.e., see step $W_{20}$. It is then determined whether or not paper has been discharged outwardly, see step $W_{21}$, and whether drive motor 60 has stopped, see step $W_{22}$. When the original table has not been returned to its home position, i.e., when step $W_{19}$ is NO, it is determined, as noted above, by the output of the reed switch 10*b*, whether or not reproduction unit 2 is at its original image reproduction position, i.e., see step $W_{23}$. When reproduction unit 2 is located at its original image reproducing position, the process returns to step $W_{19}$, which repeats itself until the original table moves into its home position. When the original table is returning to its home position and reproduction unit 2 is not located at its original image reproduction position, i.e., when step $W_{23}$ is NO, the process returns to step $W_{15}$ to advance to steps $W_{16}$ and $W_{17}$, so that paper can be discharged outwardly to prevent paper from jamming.

In the case in which a plurality of copies of an original are to be made, i.e., when step $W_{18}$ is YES, paper supply is again started from paper supply cassette 18, see step $W_{24}$, and it is determined whether or not waiting switch 28 is switched on (see step $W_{25}$). When waiting switch 28 is switched on, i.e., when step $W_{25}$ is YES, waiting rollers 20 which are being driven to feed the previous paper will be stopped, see step $W_{26}$, and it will then be determined whether or not the original table is at its home position, see step $W_{27}$. When the original table is returned to its home position, i.e., when step $W_{27}$ is YES, the original table is stopped, see step $W_{28}$. The process then returns to step $W_5$, and image reproduction onto subsequent paper sheets is effected, as described previously. When the original table is not in its home position, i.e., when step $W_{27}$ is NO, the reed switch 10*b* determines, prior to return of the original table to its home position, whether or not reproduction unit 2 is moved into its original image reproducing position, i.e., see step $W_{29}$. When it is moved, i.e., when step $W_{29}$ is NO, the process advances from step $W_{15}$ to step $W_{16}$ and step $W_{17}$ through flow chart branch 3, as described above. When the original table is not at its home position, but is instead located at its original image reproduction position, i.e., when step $W_{29}$ is YES, it is again determined whether or not the waiting switch will be turned on, see step $W_{25}$, and all of the above steps are effected until the table moves into its original home position, i.e., in which step $W_{27}$ is YES.

According to the embodiment of the present invention as described above, image reproduction is effected during detection by magnet 9 and reed sensor 10*b*, irrespective of whether reproduction unit 2 is pulled completely forwardly in order to occupy its correct original image reproduction position. Thus, the image on an original can be prevented from being reproduced when reproduction unit 2 is in an abnormal position, and original table 2*a* and the like can also be prevented from being broken as a result of their contact with board unit 1.

Further, when an image is reproduced from the board sheet, the reproduction operation is not effected when the reproduction unit is pushed fully backwardly to combine with the board, thereby making it possible to always obtain correctly reproduced images. Even when the reproduction unit is shifted during a board image reproduction operation, the reproduction operation is thereafter continued, maintaining the electricity removing lamp lit, and thus preventing solid black images from being provided as reproduced images. As a result, toner waste and cleaner life shortening can be minimized or prevented.

Further, when reproducing an image on an original, the reproduction is not effected when the reproduction unit is not completely pulled forwardly to its original image reproduction position, thereby preventing the original holding table from being broken. Additionally, even if the reproduction unit was shifted during reproduction by accident and the reproduction operation thus interrupted, the papers themselves will nonetheless be fed and discharged outwardly without leaving jammed paper in the apparatus, thereby minimizing or preventing paper jamming.

I claim:

1. An image forming device comprising:

(a) a display unit including a board display surface comprising means for receiving a handwritten image thereon, said image being erasable;

(b) a copying unit adapted to be moved between a first position in which said image written on said display surface is copied and a second position in which an original document having an image written thereon is copied, said copying unit including a photosensitive body for forming an electrostatic latent image corresponding to a handwritten image on said display surface of said original document, means for uniformly charging the surface of said photosensitive body, and means for removing unnecessary charges from said photosensitive body surface and for removing electric charges on said photosensitive surface when said copying unit is not located at either of said first or second positions;

(c) means for detecting whether said copying unit is located at a predetermined position; and (d) means for actuating said charge eraser means in response to the output of said detecting means.

2. An image forming device in accordance with claim 1, wherein said detecting means comprises means for detecting when said copying unit is located in said first position, in which any image written on said display surface of said display section is to be copied.

3. An image forming device in accordance with claim 1, wherein said detecting means comprises at least one reed switch on said copying unit which is adapted to be positioned under a magnet on an assembly for moving said copying unit.

4. An image forming device in accordance with claim 1, wherein said detecting means comprises means for detecting the presence of said copying unit at said second position, in which an image on an original document is copied.

5. An image forming device in accordance with claim 1, said detecting means comprising a magnet fixedly mounted on said copying unit and a reed switch fixedly mounted on said display section.

6. An image forming device in accordance with claim 1, said copying unit further comprising means for developing said electrostatic latent image, said charge erasing means being positioned downstream from said charging means and upstream from said developing means, as viewed with respect to a predetermined direction of rotation of said photosensitive body.

7. An image forming device in accordance with claim 1, said charge erasing means comprising an electric charge erasing lamp for exposing the surface of said photosensitive body.

8. An image forming device comprising:

(a) a display section including a board display surface comprising means for receiving a handwritten image and for permitting erasure of said image;

(b) a copying unit which is movable between a first position in which an image written on said display surface is copied and a second position in which an original document having an image written thereon is copied, said copying unit including a photosensitive body comprising means for forming an electrostatic latent image corresponding to a handwritten image on said display surface or said original document, means for uniformly charging said photosensitive body surface, means for removing unnecessary charges from said photosensitive body surface and for removing electric charges from said photosensitive surface when said copying unit is not located at either of said first or second positions;

(c) means for detecting the position of said copying unit; and (d) means for actuating said charge removing means so that when said detecting means detects, during copying of an image on said display surface, that said copying unit is not located at said first position, it will complete a copying operation.

9. An image forming device in accordance with claim 8, said actuating means comprising means for completing a copying operation when said detecting means detects that said copying section is not located at said second position during copying of an image on an original document.

10. An image forming device in accordance with claim 8, wherein said detecting means comprises a magnet fixedly mounted on said copying unit and a reed switch fixedly mounted on said display section.

11. An image forming device in accordance with claim 8, wherein said copying unit further comprises means for developing said electrostatic latent image, said charge erasing means being located downstream from said charging means and upstream from said developing means, as viewed with respect to a predetermined direction of rotation of said photosensitive body.

12. An image forming device in accordance with claim 8, said charge erasing means comprising an electric charge erasing lamp for exposing the surface of said photosensitive body.

13. An image forming device which comprises a display section having a board display surface on which an image can be written, a copying unit which is movable between a first position in which an image written on the display surface is adapted to be copied and a second position in which an original document having an image written thereon is adapted to be copied, said copying section including a photosensitive body, means for charging the surface of said body, means for erasing unecessary charges from said photosensitive body, means for detecting where said copying unit is located, and means for actuating said erasing means in response to receipt of the output of said detecting means.

* * * * *

UNITED STATES PATENT AND TRADEMARK OFFICE

CERTIFICATE OF CORRECTION

PATENT NO. : 4,733,271

DATED : March 22, 1988

INVENTOR(S) : Koichi ARAI

It is certified that error appears in the above-identified patent and that said Letters Patent is hereby corrected as shown below:

At column 1, line 20, insert ---An--- before "Image".

At column 1, line 20, change "Image" to ---image---.

At column 1, line 29, change "when" to ---During---.

At column 1, line 29, change "reproduction is effected, with" to ---reproduction, if---.

At column 2, line 43, insert ---a--- after "is" and before "circuit".

At column 2, line 52, delete "," after "represents" and before "the".

At column 6, lines 28 and 29, change "electrical-removing" to ---electricity-removing---.

At column 6, line 51, change "reproducting" to ---reproducing---.

At column 6, line 56, change "reproducting" to ---reproducing---.

At column 8, line 34, change "Step" to ---step---.

At column 9, line 1, change "yes" to ---YES---.

At column 9, line 14, insert ---an--- after "of" and before "image".

At column 9, line 26, insert ---a--- after "and" at end of line.

At column 9, line 27, change "roduction" to ---reproduction---.

At column 9, line 30, change "s" to ---has---.

At column 9, line 38, change "ch" to ---which---.

UNITED STATES PATENT AND TRADEMARK OFFICE

CERTIFICATE OF CORRECTION

PATENT NO. : 4,733,271

DATED : March 22, 1988

INVENTOR(S) : Koichi ARAI

It is certified that error appears in the above-identified patent and that said Letters Patent is hereby corrected as shown below:

At column 9, line 60, change "moving" to ---removing---.

At column 10, line 8, delete "a to".

At column 10, line 9, insert ---or not--- after "present" and before ",".

At column 10, line 27, insert ---,--- after "i.e." and before "see".

Signed and Sealed this

Twenty-seventh Day of June, 1989

*Attest:*

*Attesting Officer*

DONALD J. QUIGG

*Commissioner of Patents and Trademarks*